US006643883B1

(12) United States Patent
Kajihara et al.

(10) Patent No.: US 6,643,883 B1
(45) Date of Patent: Nov. 11, 2003

(54) WIPER FOR LIQUID SUBSTANCES

(75) Inventors: Tetsuo Kajihara, Hiroshima (JP); Hiroshi Matsuo, Hiroshima (JP); Eiji Koumoto, Hiroshima (JP); Yoichi Hangai, Hiroshima (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/582,439

(22) PCT Filed: Oct. 14, 1999

(86) PCT No.: PCT/JP99/05653

§ 371 (c)(1),
(2), (4) Date: Jun. 26, 2000

(87) PCT Pub. No.: WO00/24534

PCT Pub. Date: May 4, 2000

(30) Foreign Application Priority Data

Oct. 26, 1998 (JP) ..... 10-303873

(51) Int. Cl.[7] ..... B21B 13/14

(52) U.S. Cl. ..... 15/102; 15/256.5; 15/97.1; 15/306.1; 72/243

(58) Field of Search ..... 15/102, 100, 256.5, 15/306.1, 308, 309.1, 309.2, 97.1; 72/40, 243.6, 241.4, 247

(56) References Cited

U.S. PATENT DOCUMENTS

| | | | | | |
|---|---|---|---|---|---|
| 1,910,148 | A | * | 5/1933 | Buckwalter | 72/243.6 |
| 3,306,091 | A | * | 2/1967 | Bursk | 72/240 |
| 4,440,012 | A | * | 4/1984 | Feldmann et al. | 72/201 |
| 4,882,922 | A | * | 11/1989 | Dominique | 72/241.6 |
| 5,021,265 | A | * | 6/1991 | Bald et al. | 427/365 |
| 5,634,257 | A | * | 6/1997 | Kajiwara et al. | 29/527.7 |
| 5,737,796 | A | | 4/1998 | Sendzimir et al. | |
| 6,151,944 | A | * | 11/2000 | Lecrivain | 72/241.6 |
| 6,314,782 | B1 | * | 11/2001 | Stahl et al. | 72/241.8 |

FOREIGN PATENT DOCUMENTS

| | | | | |
|---|---|---|---|---|
| DE | 4331261 | A1 * | 4/1994 | B21B/13/14 |
| EP | 0263334 | A | 4/1988 | |
| JP | 2295609 | A | 12/1990 | |
| JP | 6-39423 | A | 2/1994 | |
| JP | 6-079334 | A | 3/1994 | |
| JP | 6079336 | A | 3/1994 | |
| JP | 10-146611a | | 6/1998 | |

* cited by examiner

*Primary Examiner*—Robert J. Warden, Sr.
*Assistant Examiner*—Shay L Balsis
(74) *Attorney, Agent, or Firm*—Birch, Stewart, Kolasch & Birch, LLP

(57) ABSTRACT

A wiper apparatus which sandwiches a strip plate 2 between upper and lower wiper rolls 3 and 4 to squeeze out a rolling oil adhering to the strip plate 2, wherein backup rolls 5, 6 for reinforcing the wiper rolls 3, 4 each have a single sleeve 14 rotatably supported by two bearings 13 on a roll shaft, and the bearings 13 on the upper and lower backup rolls 5 and 6 are disposed on the roll shafts with a shorter span than the barrel length of the sleeve, and in point symmetry. Thus, a contact linear pressure distribution of the wiper rolls 3, 4 on the strip plate 2 can be made uniform.

9 Claims, 14 Drawing Sheets

Contact Linear Pressure ; Load 600 Kgf、Plate Width 600mm、
Backup Roll 30t、Support Span 600mm、
Reference Support Point 450−150mm、
Barrel Length 1250mm Contact Linear Pressure ; Load 1100 Kgf、Plate Width 1100mm、
Backup Roll 30t、Support Span 600mm、
Reference Support Point 450−150mm、
Barrel Length 1250mm

WIPER FOR LIQUID SUBSTANCES

This application is the national phase under 35 U.S.C. §371 of PCT International Application No. PCT/JP99/05653 which has an International filing date of Oct. 14, 1999, which designated the United States of America.

TECHNICAL FIELD

This invention relates to a wiper apparatus for wiping off a liquid material such as a rolling oil, which has adhered to surfaces of a strip plate rolled by a cold rolling mill, by means of upper and lower rolls.

BACKGROUND ART

As this type of wiper apparatus, there has been one as shown, for example, in FIGS. 22 and 23.

As shown in FIG. 23, a roll type wiper apparatus 42 has been provided, on an exit side of a cold rolling mill 40, for wiping off a rolling oil or the like, which has adhered to surfaces of a rolled strip plate 41. The strip plate 41 deprived of the rolling oil or the like by the wiper apparatus 42 is wound onto a winder 43. As an example of such a roll type wiper apparatus, the "wiper apparatus" disclosed in Japanese Unexamined Patent Publication No. 1994-39423 is known.

In this apparatus, as shown in FIG. 22, an upper wiper roll 53 and a lower wiper roll 54, each having a small diameter, are provided on an upper frame 51 and a lower frame 52, which are symmetrical to each other, in such a manner as to sandwich the strip plate 41. On shafts 56 supported by saddles 55, upper and lower backup rolls 57 as a pair, which have been split in the axial direction (split into 5 segments in the illustrated example), are provided in contact with the upper and lower wiper rolls 53 and 54. Hydraulic pressing cylinders 58, hydraulic bending cylinders 59, and air jet nozzles 60 are also provided.

Thus, the strip plate 41 pushed out of the rolling mill 40 enters between the upper and lower wiper rolls 53 and 54 of the wiper apparatus 42. The upper and lower wiper rolls 53 and 54 are rotated while being pressed against the surfaces of the strip plate 41 via the split backup rolls 57 under the pressing force of the pressing cylinders 58. As a result, the rolling oil or the like that has adhered to the surfaces of the strip plate 41 is wiped, and ejected air from the air jet nozzles 60 blows off the rolling oil or the like flowing out from both end faces of the strip plate 41.

However, the conventional apparatus as described above poses the following problems:

(1) The presence and absence of the split backup rolls 57 put banded marks on the small-diameter wiper rolls 53 and 54. These marks are transferred as flaws onto the surfaces of the strip plate wiped.

(2) When the rolled strip plate 41 is wound on the winder 43 with the rolling oil or the like adhering, the plate slips in the wound coil to scar the surface. Alternatively, the strip plate 41 shoots out laterally like a bamboo shoot, resulting in a winding failure. To remove the rolling oil from the entire surface of the strip plate 41, the wiper rolls 53, 54 may be pressed against the strip plate 41 at high load so as to contact the entire surface of the strip plate 41. In this case, the strip plate 41 is locally plastically deformed, and its flatness is deteriorated.

(3) When the plate width of the strip plate 41 rolled has changed, the positions in the pressing direction of the individual split backup rolls 57 need to be adjusted on the order of micrometers. Thus, a detecting/controlling device with high precision is required, resulting in a cost increase.

(4) If the backup roll 57 is an unsplit roll having a shaft supported at both ends, barrel length (roll shaft direction) central parts of the wiper rolls 53, 54 warp under the reaction force of the strip plate 41 against pressing. Thus, the rolling oil in a central part of the strip plate 41 cannot be fully removed.

Therefore, the object of the present invention is to provide a wiper apparatus for a liquid material, which can squeeze out the liquid material, which has adhered to a rolled material, at a low cost without impairing the quality of the rolled material.

DISCLOSURE OF THE INVENTION

To attain the above object, a wiper apparatus for a liquid material according to the present invention is a wiper apparatus which sandwiches a moving rolled material between upper and lower wiper rolls to squeeze out the liquid material adhering to the rolled material, characterized in that backup rolls for reinforcing the wiper rolls each have a single sleeve rotatably supported by two bearings on a roll shaft, and the bearings on the upper and lower backup rolls are disposed on the roll shafts with a shorter span than a barrel length of the sleeve, and in point symmetry.

Thus, the following effects are obtained: ① The backup roll may comprise a single-barrel type sleeve which has not been split. Hence, the problem of causing banded marks to the wiper roll is no more existent. ② The single sleeve is supported by the bearings disposed with a shorter span than the sleeve barrel length. Hence, even if the plate width increases, warp of the sleeve does not increase, and even if the plate width changes, a change in the contact linear pressure decreases. ③ The bearing support points of the upper and lower single sleeves are arranged in point symmetry. Hence, the gap between the wiper rolls is supported at four points, so that the contact linear pressure is easily uniformed. ④ Since the uniforming performance for the contact linear pressure is great, points with zero linear pressure vanish. As a result, the pressing load of the wiper rolls can be decreased, and the problem of plastic deformation of the plate is resolved.

The upper and lower backup rolls may be constituted to be movable axially in opposite directions.

Thus, the contact linear pressure can be uniformed, even when the plate width has changed greatly.

The inner surface of the single sleeve may be composed of a stepped surface so that a middle portion thereof will be thick-walled and both ends thereof will be thin-walled, and the bearing may be disposed fixedly at stepped portions of the stepped surface.

Thus, the positioning of the bearings is facilitated.

The backup rolls may be constituted in such a manner as to support the wiper roll by one reinforcing roll.

Thus, the number of the backup rolls is minimized.

The backup rolls may be constituted in such a manner as to support the wiper roll by two reinforcing rolls.

Thus, small-diameter backup rolls are realized.

A wiper apparatus for a liquid material according to the present invention is a wiper apparatus which sandwiches a moving rolled material between upper and lower wiper rolls to squeeze out the liquid material adhering to the rolled material, characterized in that the upper and lower wiper rolls are each supported by two single-sleeve type backup rolls, and bearings for supporting sleeves of the upper right and left backup rolls are disposed in point symmetry, and bearings for supporting sleeves of the lower right and left backup rolls are disposed in point symmetry.

Thus, the following effects are obtained: ① The backup roll may comprise a single-barrel type sleeve which has not been split. Hence, the problem of causing banded marks to the wiper roll is no more existent. ② The single sleeve is supported by the bearings disposed with a shorter span than the sleeve barrel length. Hence, even if the plate width increases, warp of the sleeve does not increase, and even if the plate width changes, a change in the contact linear pressure decreases. ③ The bearing support points of the upper and lower single sleeves are arranged in point symmetry. Hence, the gap between the wiper rolls is supported by four points, so that the contact linear pressure is easily uniformed. ④ Since the uniforming performance for the contact linear pressure is great, points with zero linear pressure vanish. As a result, the pressing load of the wiper rolls can be decreased, and the problem of plastic deformation of the plate is resolved.

At least either the upper two backup rolls or the lower two backup rolls may be constituted to be adjustable in such a manner as to be moved axially in opposite directions.

Thus, either the upper backup rolls, or the lower backup rolls need not be controlled to be moved in a shifting direction. Hence, a roll shift mechanism can be simplified.

A wiper apparatus for a liquid material according to the present invention is a wiper apparatus which sandwiches a moving rolled material between upper and lower wiper rolls to squeeze out the liquid material adhering to the rolled material, characterized in that backup rolls for reinforcing the wiper rolls are provided, crownings are formed in the wiper rolls, and means for enabling the wiper rolls to move parallel to the rolled material is provided.

Thus, even when the plate width of the rolled material changes, the contact linear pressure distribution can be uniformed, and the liquid material adhering to the rolled material can be wiped off satisfactorily. Since the contact linear pressure distribution can be uniformed, moreover, local plastic deformation can be prevented, and the product quality of the rolled material can be improved. Furthermore, even for the rolled material formed of a material which is too easily plastically deformable to receive a high load, the contact linear pressure distribution can be uniformed, so that the quality deterioration of the rolled material can be prevented.

BEST MODE FOR CARRYING OUT THE INVENTION

A wiper apparatus for a liquid material according to the present invention will be described in detail by way of embodiments with reference to the accompanying drawings.

First Embodiment

Figure 1:
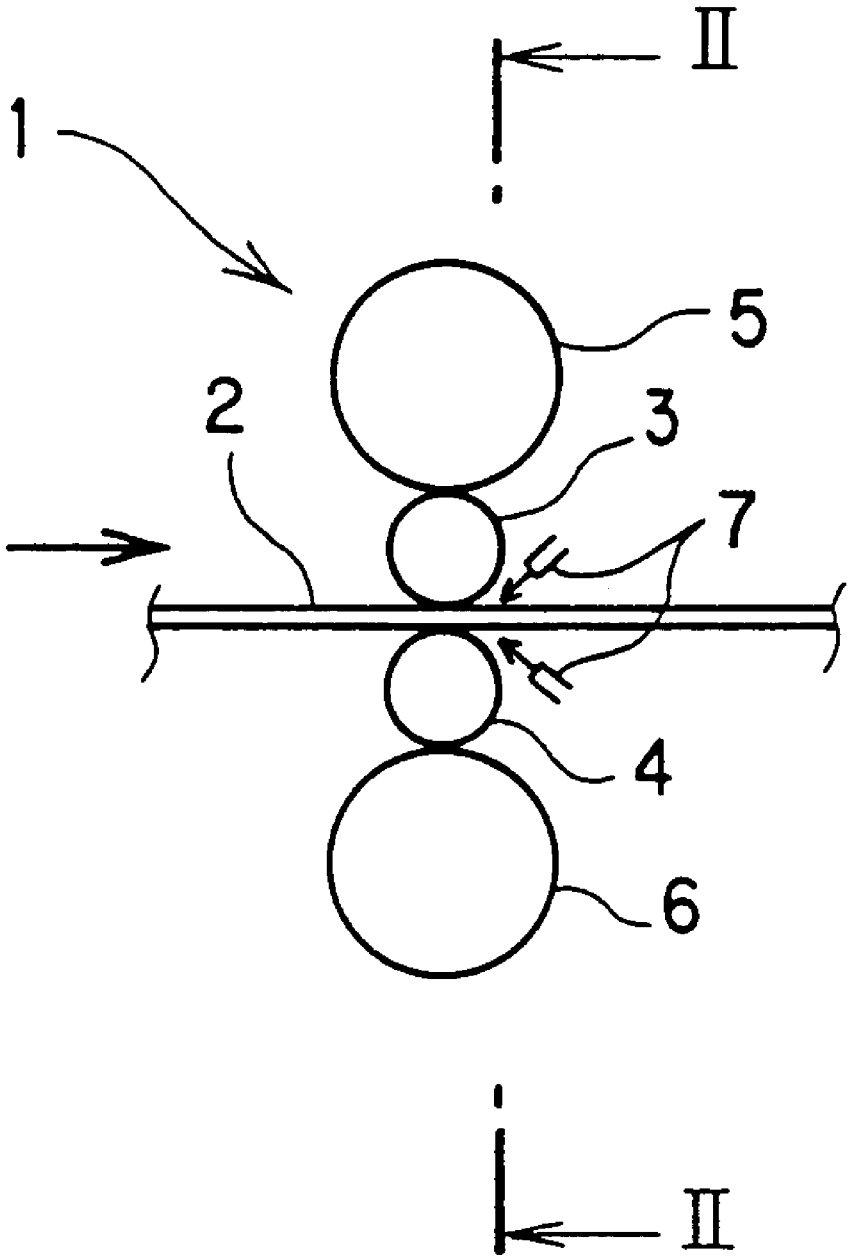
FIG. 1 is a side view of a roll configuration of a wiper apparatus according to a first embodiment of the present invention.
Figure 2:
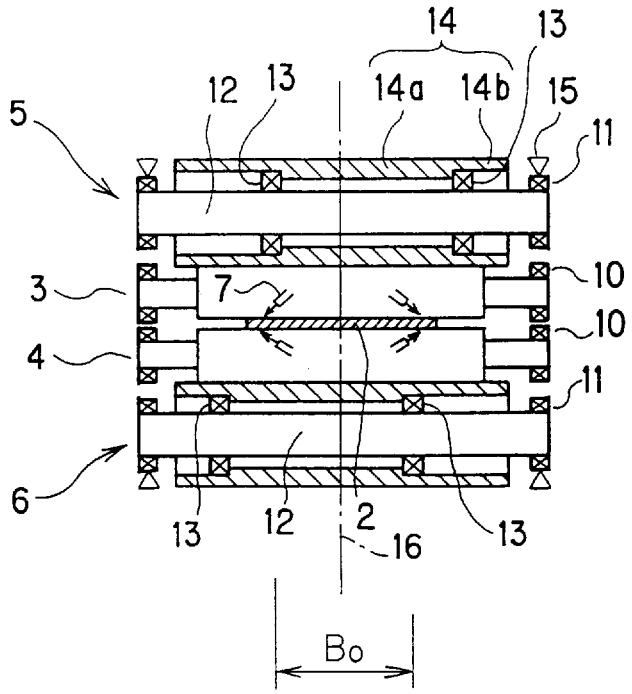
FIG. 2 is a sectional view taken on line II—II of FIG. 1.
Figure 9A:
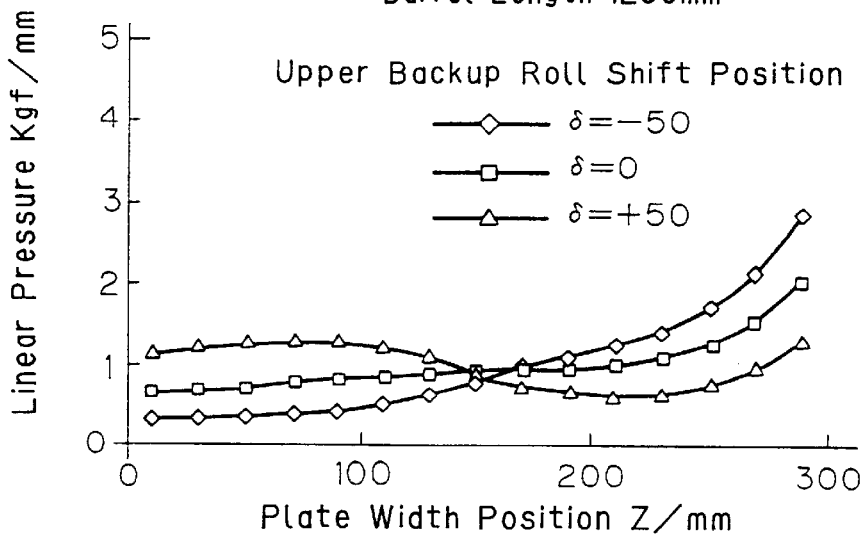
FIGS. 9(*a*) and 9(*b*) are each a graph showing the results of detection of a contact linear pressure when a strip plate is wiped with the wiper apparatus of the present invention, in which FIG. 9(*a*) shows the strip plate with a plate width of 600 mm, and FIG. 9(*b*) shows the strip plate with a plate width of 1,100 mm.
Figure 9B:
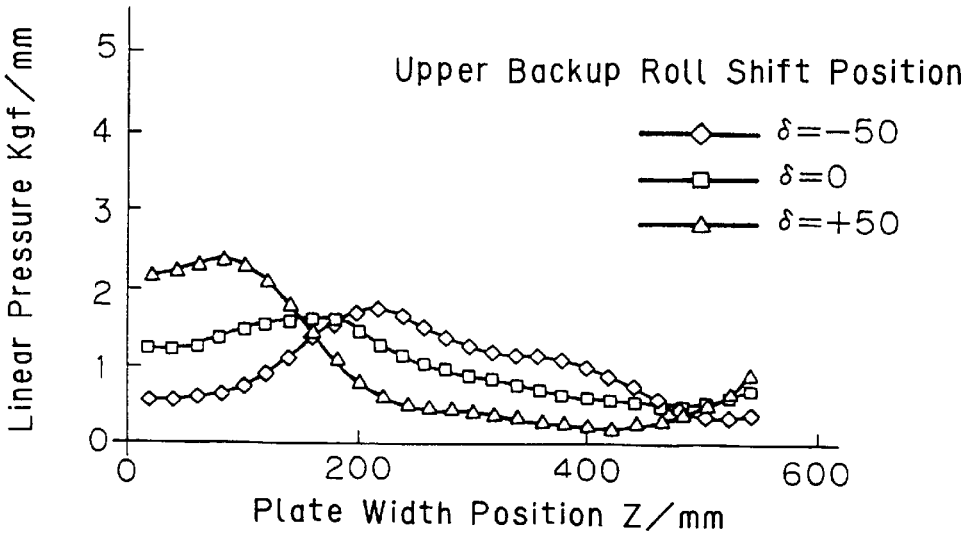
Figure 19A:
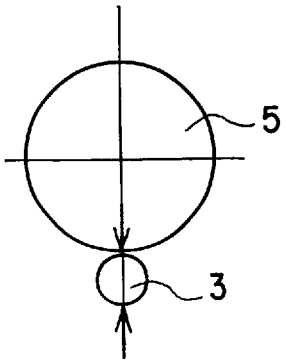
FIGS. 19(*a*) to 19(*c*) are explanation views for principle, with an unsplit backup roll being present in the wiper apparatus (FIGS. 19(*a*) and 19(*b*), and crowning being formed in the wiper roll (FIG. 19(*c*)).
Figure 19B:
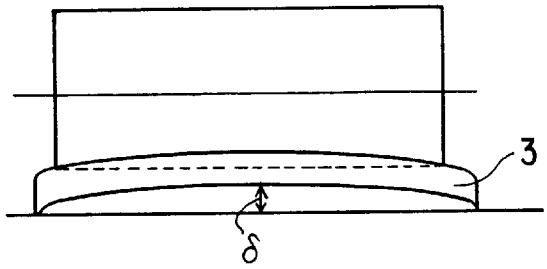
Figure 19C:
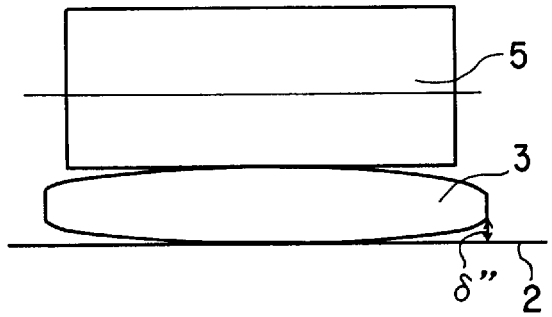
Figure 20A:
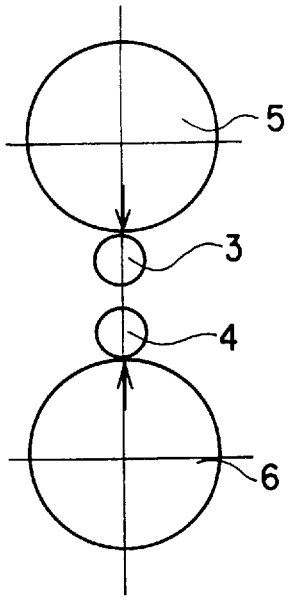
FIGS. 20(*a*) and 20(*b*) are explanation views for principle when the bearing positions of the backup rolls are arranged in point symmetry, in which FIG. 20(*a*) is a side view of an essential part, while FIG. 20(*b*) is a front view of the essential part.
Figure 20B:
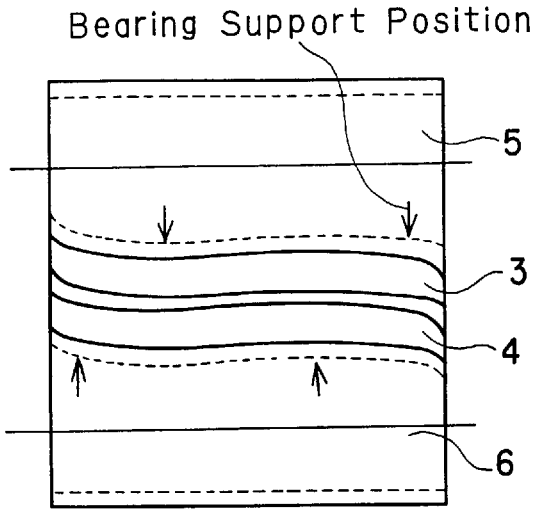

FIG. 1 is a side view of a roll configuration of a wiper apparatus according to a first embodiment of the present invention. FIG. 2 is a sectional view taken on line II—II of FIG. 1. FIGS. 9(*a*) and 9(*b*) are graphs showing the results of detection of contact linear pressures in the plate width direction of wiper rolls when two strip plates with different plate widths are wiped with the wiper apparatus of the present invention. FIGS. 19(*a*) to 19(*c*) are explanation views for principle, with an unsplit backup roll being present in the wiper apparatus (FIGS. 19(*a*) and 19(*b*)), and crowning being formed in the wiper roll (FIG. 19(*c*)). FIGS. 20(*a*) and 20(*b*) are explanation views for principle when the bearing positions of backup rolls are arranged in point symmetry.

In FIG. 1, the reference numeral 1 denotes a wiper apparatus, and 2 a strip plate as a rolled material to be wiped with the wiper apparatus 1. The wiper apparatus 1 is composed of a small-diameter upper wiper roll 3 and a small-diameter lower wiper roll 4 having both ends supported by bearings on upper and lower frames (not shown) in such a manner as to sandwich the strip plate 2; a single-sleeve (larger in diameter than the upper or lower wiper roll) type upper backup roll 5 and a single-sleeve type lower backup roll 6 having both ends supported by bearings on the upper and lower frames (not shown) in such a manner as to contact the wiper rolls 3 and 4; and upper and lower air jet nozzles 7 provided on the exit side of the upper and lower wiper rolls 3 and 4. To make the constitution of the wiper apparatus of the present embodiment easier to understand in FIGS. 1 and 2, the other portions including the support frames are not shown.

In FIG. 2, the upper wiper roll 3 and the lower wiper roll 4 have both ends rotatably supported in fixed journal boxes on the upper frame and the lower frame via bearings 10. The upper backup roll 5 and the lower backup roll 6 are each composed of a support shaft 12 having both ends rotatably supported by bearings 11 on the upper or lower frame (not shown), and a single sleeve 14 rotatably supported by bearings 13 at two sites on the support shaft 12.

The two bearings 13 on the support shaft 12 supporting the single sleeve 14 of the upper backup roll 5, and the same two bearings 13 on the lower backup roll 6 are provided in point symmetry about a center line 16 of the rolling line.

The inner surface of the single sleeve 14 of each of the upper and lower backup rolls 5 and 6 is formed from a stepped surface so that the middle portion of the sleeve will be a thick-walled portion 14*a*, and both end portions of the sleeve will be thin-walled portions 14*b*. At the stepped portions of the stepped surface, the two bearings 13 are fixed, and the two bearings 13 of the upper backup roll 5 and the two bearings 13 of the lower backup roll 6 are arranged in point symmetry.

In FIG. 2, the mark ▽ (numeral 15) denotes a point of action of a pressing force which a pressing cylinder connected to the upper frame imposes on the support shaft 12 of the backup roll 5 or 6.

Figure 22:
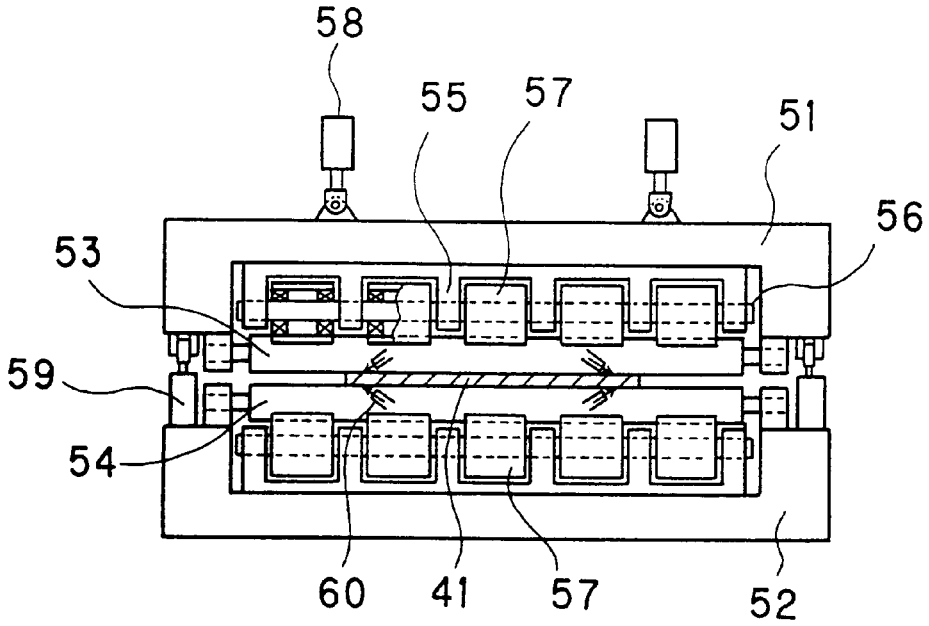
FIG. 22 is a front view of a conventional wiper apparatus.
Figure 23:
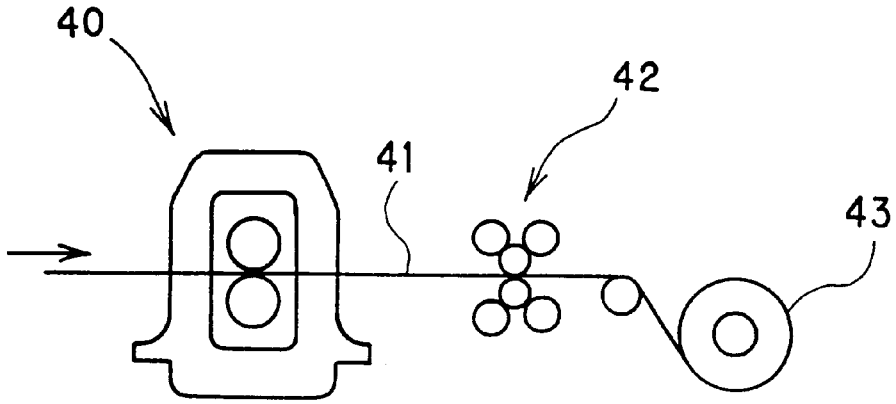
FIG. 23 is a side view of an essential part of a rolling line.

Between the shaft ends of the upper and lower wiper rolls 3 and 4, bending cylinders may be provided as in the earlier technology (FIG. 22).

In the wiper apparatus of the foregoing constitution, the pressing force imposed on the support shaft 12 of the backup roll 5 or 6 by the pressing cylinder is transmitted from the bearings 13 at the two sites on the support shaft 12 to the single sleeve 14, pressing the single sleeve 14 against the strip plate 2.

Wiping of the rolled strip plate 2 is performed in the following manner: The upper and lower backup rolls 5 and 6 are adjusted to be moved in the axial direction relative to each other so that the paired-up bearings 13 in point symmetry in the upper and lower backup rolls 5 and 6 will be located near both sides in the width direction of the strip plate 2 in correspondence with the plate width of the strip plate 2. Then, while the strip plate 2 is being passed, the wiper rolls 3 and 4 are lightly pressed down by the pressing force of the pressing cylinders. As a result, the wiper rolls 3 and 4 are pressed against the strip plate 2 and rotated in such a manner as to follow the strip plate 2, whereby the liquid material on the plate surfaces, such as a rolling oil, is wiped. Then, the liquid material on the side portions of the strip plate 2 is blown off by the air jet nozzles 7 on the exit side of the wiper rolls 3 and 4.

FIG. 2 shows a state in which the center of the upper and lower wiper rolls 3 and 4, as well as the upper and lower backup rolls 5 and 6, of the wiper apparatus 1 is brought into agreement with the center line 16 of the rolling line, i.e., a state in which the upper and lower backup rolls 5 and 6 are fixed and held at a zero shift position. At this time, the paired-up bearings 13, 13 in point symmetry on the upper and lower backup rolls 5 and 6 fall into such a state as to support the areas near both ends of the strip plate 2 at a distance Bo from each other while bridging over the center line 16 of the rolling line.

FIGS. 9(*a*) and 9(*b*) show two experimental examples in which wiping was performed in the wiper apparatus 1 of the above-described constitution, with the width of, and the pressing force on, the strip plate 2 being changed.

In the experimental example of FIG. 9(*a*), a plate width of 600 mm and a pressing load of 600 kgf were adopted. In the experimental example of FIG. 9(*b*), a plate width of 1,100 mm and a pressing load of 1,100 kgf were adopted. Other conditions were the same. Under these conditions, wiping was carried out, with the shift amount of the backup roll being set at 0, +50, or −50. The results of detection of the contact linear pressure in the plate width direction during each wiping are offered in the drawings.

The contact linear pressure of the wiper rolls 3, 4 that was averaged in the plate width direction was obtained in FIG. 9(*a*) when the shift amount was +50 mm, and in FIG. 9(*b*) when the shift amount was zero. This clearly shows the effect obtained when the two (upper and lower) bearings 13 were provided in point symmetry in the up-and-down direction on the single-sleeve type backup rolls.

That is, a wiper apparatus requires that upper and lower wiper rolls be pressed against a strip plate in order to wipe and remove a liquid material (such as a rolling oil), which has adhered to the surface of the strip plate, by means of the wiper rolls. As shown in FIGS. 19(*a*) and 19(*b*), however, the wiper roll 3 has a barrel length middle portion warped by a reaction force of the strip plate against pressing, so that the rolling oil in the middle portion of the strip plate cannot be fully removed. To prevent this drawback, warpage of the wiper roll 3 must be compensated for, the gap between the upper and lower wiper rolls must be uniformed in the plate width direction, and the contact linear pressure on the strip plate must be made uniform.

To solve this problem, there is a method, as in FIG. 19(*c*), in which a crowning δ with a large diameter at the middle of the barrel length is applied to the wiper roll 3. However, the pressing force of the wiper roll 3 varies with the plate width or the plate thickness, and warpage of the wiper roll 3 also varies in proportion to the pressing force. Thus, it is necessary to stock many types of wiper rolls 3 with varying crowning amounts, and replace the wiper roll 3 according to the type of the product. This poses a new problem of deteriorating economy and productivity markedly.

In the present embodiment, as shown in FIGS. 20(*a*) and 20(*b*), the bearing positions at which the sleeves of the backup rolls 5 and 6 are rotatably supported are arranged in point symmetry in the up-and-down direction. In this case, the sleeves of the backup rolls 5 and 6 warp in an S-shape, as shown in FIG. 20(*b*), with the bearing positions as fulcra. If the bearing positions are adjusted according to the pressing force and the plate width, with the point symmetry in the up-and-down direction being kept, the contact linear pressure can be uniformed under various conditions with the use of a single type of wiper roll 3 or 4. Adjusting means for the bearing position may be to move the upper and lower backup rolls 5 and 6 axially in opposite directions, as in the Embodiments to be offered later on. Merely setting the bearing positions in point symmetry beforehand produces the effect of uniforming the contact linear pressure because of the S-shaped deformation of the sleeves. Thus, when the product size or the range of variation in load is small, means for moving the backup rolls in the axial direction can be omitted.

According to the present embodiment, as stated earlier, the backup roll may comprise an unsplit single-barrel type sleeve, thus resolving the problem that banded marks occur in the wiper roll.

Also, the single sleeve 14 is supported by the bearings disposed with a shorter span than the sleeve barrel length. Thus, warpage of the sleeve does not increase even when the plate width is large. Even if the plate width changes, a change in the contact linear pressure is small.

Furthermore, the support points by the bearings 13 for the upper and lower single sleeves 14 are arranged in point symmetry. As a result, the gap between the wiper rolls is supported at four points. Thus, the contact linear pressure is easily uniformed.

Since the uniforming performance for the contact linear pressure is great, the points with zero linear pressure no more exist. Thus, the pressing load on the wiper roll can be decreased, resolving the problem of plastic deformation of the plate.

Second Embodiment

Figure 3:
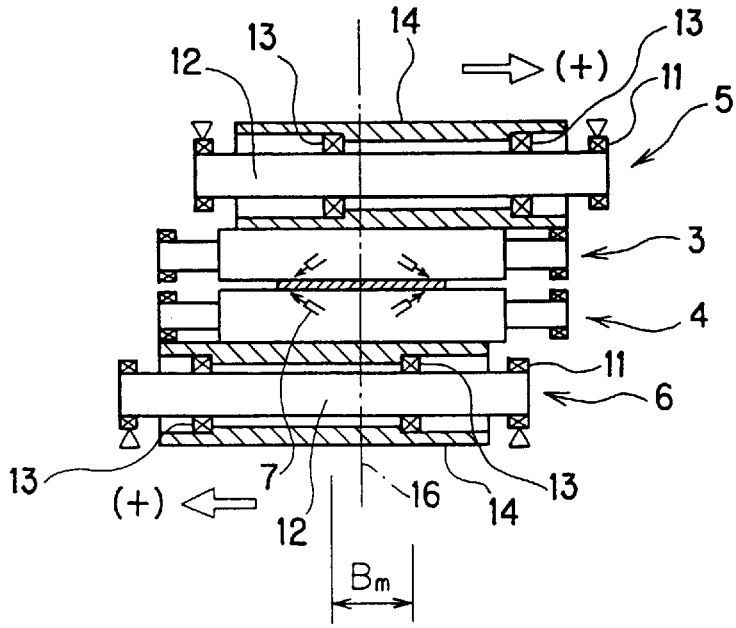
FIG. 3 is a sectional view of a roll configuration of a wiper apparatus according to a second embodiment of the present invention.

FIG. 3 is a sectional view of a roll configuration of a wiper apparatus according to a second embodiment of the present invention.

This embodiment is an embodiment in which the upper backup roll 5 and the lower backup roll 6 in the First Embodiment are each composed of a support shaft 12 having both ends rotatably supported via bearings 11 in an axially slidable, roll shifting type journal box on an upper or lower frame, and a single sleeve 14 rotatably supported by bearings 13 at two sites on the support shaft 12. The other constitutions are the same as in the First Embodiment.

FIG. 3 shows a state in which the upper backup roll 5 is axially roll shifted rightward, and the lower backup roll 6 is axially roll shifted leftward, from the state of FIG. 2. The roll shifting in this direction will be called roll shifting in the (+) direction. By this procedure, the spacing between the two bearings 13 and 13 on the upper and lower backup rolls bridging over a center line 16 of the rolling line in point symmetry is reduced to a distance Bm, so that portions near both ends of a strip plate 2 with a smaller width can be supported.

When the upper backup roll 5 is roll shifted leftward, and the lower backup roll 6 is roll shifted rightward, (i.e., in the (−) direction) from the state of FIG. 2, contrary to FIG. 3, there is an increase in the spacing between the two bearings 13 and 13 on the upper and lower backup rolls bridging over the center line 16 of the rolling line in point symmetry. Thus, portions near both ends of the strip plate 2 with a larger width can be supported.

According to the present embodiment, the upper and lower backup rolls can be moved axially in opposite directions. Thus, even when the plate width greatly changes, the advantage that the contact linear pressure can be uniformed is obtained, in addition to the same actions and effects as in the First Embodiment.

Third Embodiment

Figure 4:
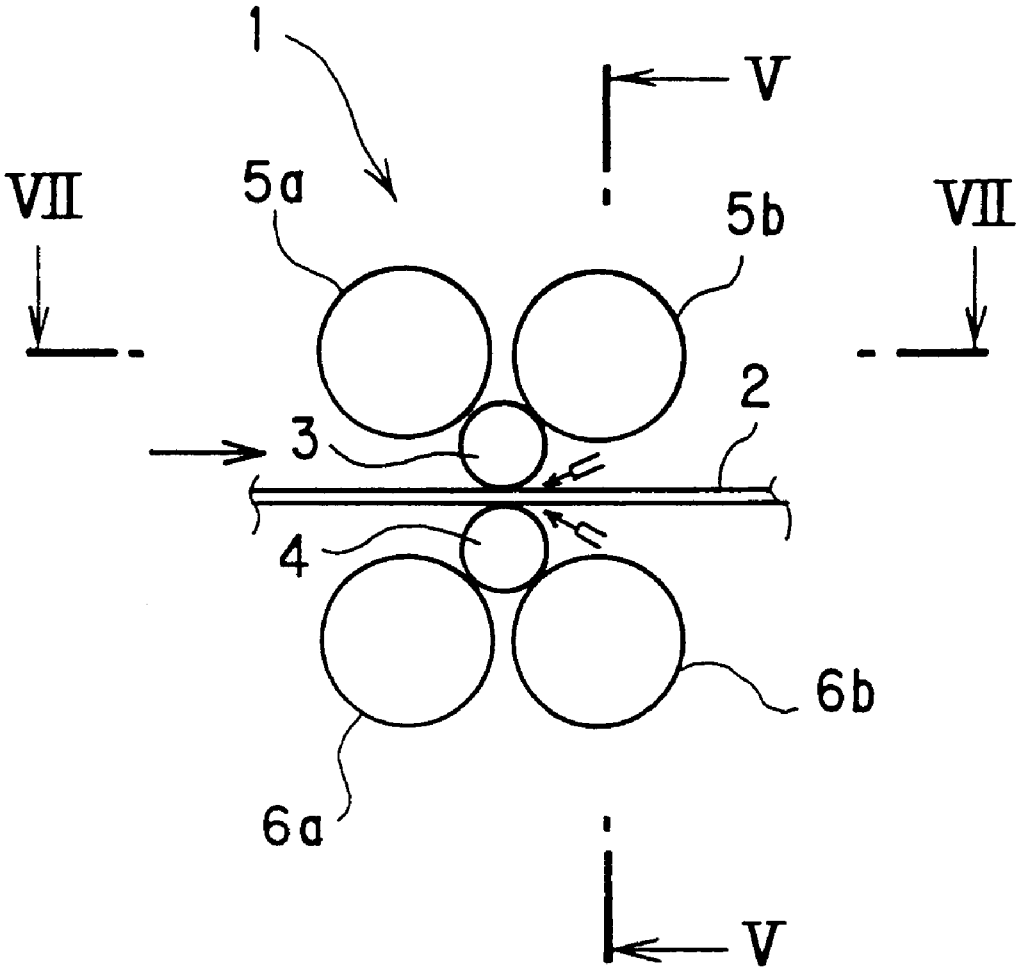
FIG. 4 is a side view of a roll configuration of a wiper apparatus according to a third embodiment of the present invention.
Figure 5:
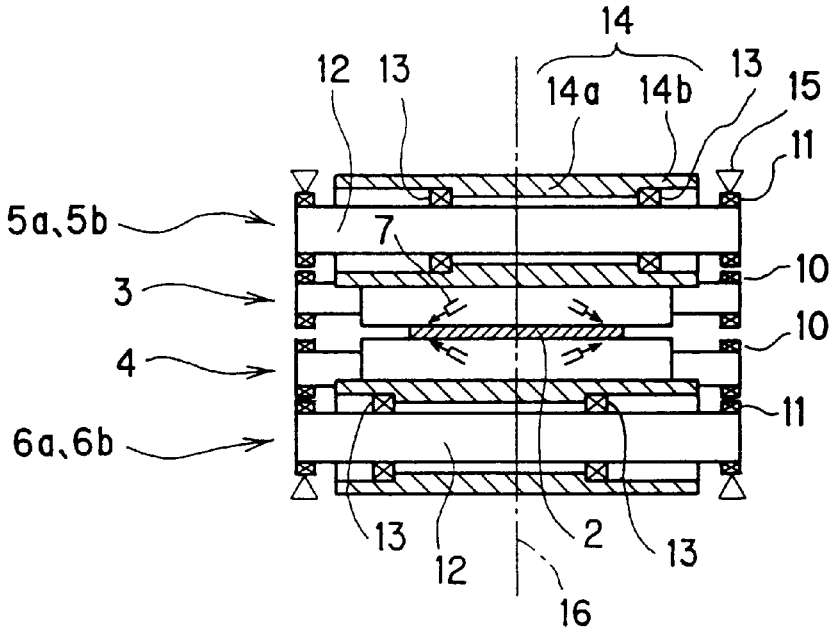
FIG. 5 is a sectional view taken on line V—V of FIG. 4.

FIG. 4 is a side view of a roll configuration of a wiper apparatus according to a third embodiment of the present invention. FIG. 5 is a sectional view taken on line V—V of FIG. 4.

As shown in FIG. 4, this embodiment is an embodiment in which two single-sleeve type backup rolls 5*a*, 5*b* and 6*a*, 6*b* are provided for an upper wiper roll 3 and a lower wiper roll 4, respectively.

In FIGS. 4 and 5, the constitution of each of the single-sleeve type backup rolls 5*a*, 5*b* and 6*a*, 6*b*, and other constitutions are the same as in the First Embodiment (FIG. 2).

The constitutions of the present embodiment have the effect that the individual backup rolls 5*a*, 5*b*, 6*a* and 6*b* can be made to have small diameters. Other actions and effects are the same as in the First Embodiment.

Fourth Embodiment

Figure 6:
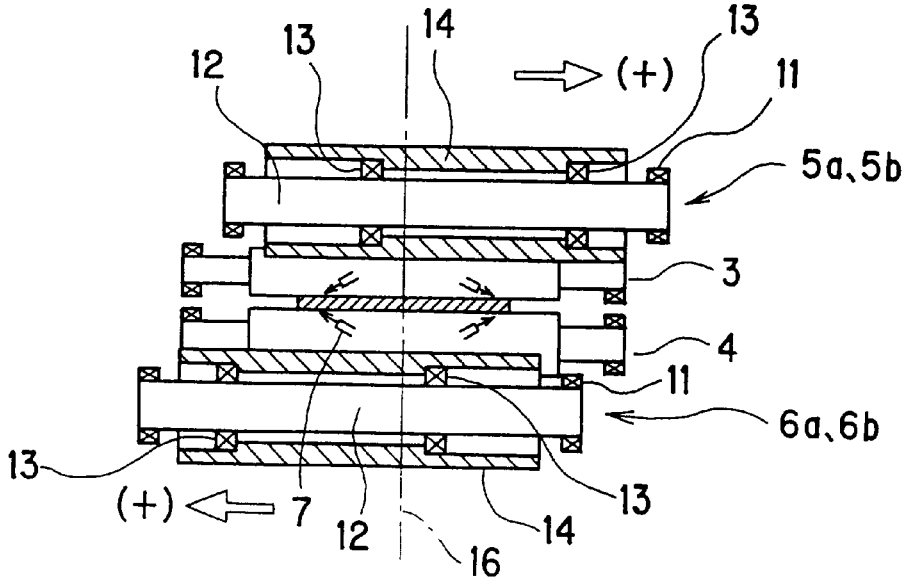
FIG. 6 is a sectional view of a roll configuration of a wiper apparatus according to a fourth embodiment of the present invention.

FIG. 6 is a sectional view of a roll configuration of a wiper apparatus according to a fourth embodiment of the present invention.

As shown in FIG. 6, according to this embodiment, two single-sleeve type backup rolls 5*a*, 5*b* and 6*a*, 6*b* are provided for an upper wiper roll 3 and a lower wiper roll 4, respectively. The upper two backup rolls as a unit, and the lower two backup rolls as a unit are movable axially in opposite directions.

In FIG. 6, the constitution of each of the single-sleeve type backup rolls 5*a*, 5*b*, 6*a* and 6*b*, and other constitutions are the same as in the First Embodiment (FIG. 2).

The constitutions of the present embodiment have the effects that the individual backup rolls 5*a*, 5*b*, 6*a* and 6*b* can be made to have small diameters, and that the upper and lower backup rolls can be moved axially in opposite directions. This conveys the advantage that the contact linear pressure can be uniformed, even if the plate width changes markedly. Other actions and effects are the same as in the First Embodiment.

Fifth Embodiment

Figure 7:
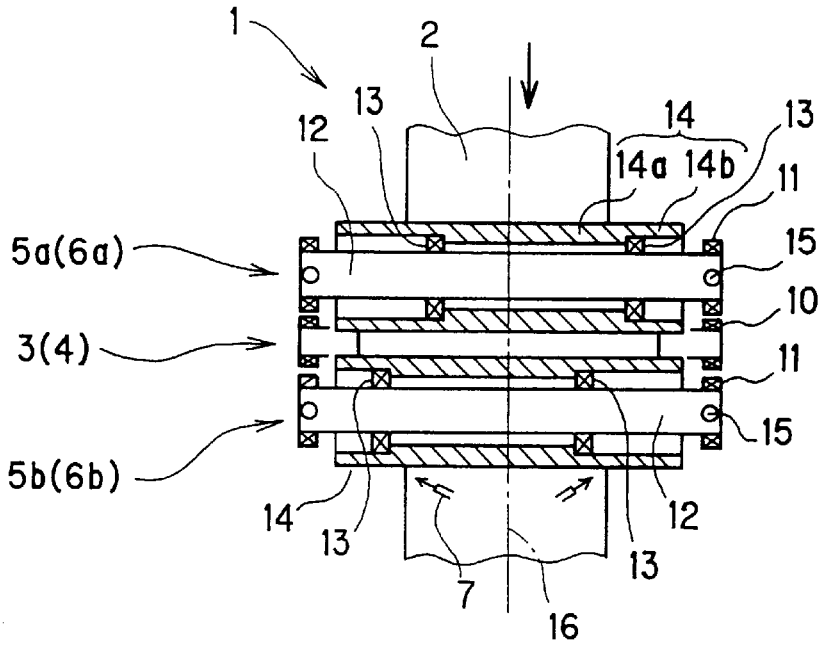
FIG. 7 is a sectional view of a wiper apparatus according to a fifth embodiment of the present invention.

FIG. 7 is a sectional view of a wiper apparatus according to a fifth embodiment of the present invention, corresponding to a sectional view taken on line VII—VII of FIG. 4.

This embodiment is a wiper apparatus having upper and lower wiper rolls 3 and 4 supported by two backup rolls 5*a*, 5*b* and 6*a*, 6*b*, respectively, as in the case of the Third Embodiment, in which, however, right and left sleeve support bearings 13 and 13 are arranged in point symmetry for the upper two single-sleeve type backup rolls 5*a* and 5*b*, and the lower two single-sleeve type backup rolls 6*a* and 6*b*.

That is, as shown in FIG. 7, the bearings 13, 13 for supporting the single-sleeves 14 of the right and left backup rolls 5*a* and 5*b*, and the right and left backup rolls 6*a* and 6*b* are arranged in point symmetry in a zero shift amount state in which the center of the right and left backup rolls 5*a* and 5*b*, the right and left backup rolls 6*a* and 6*b*, and the wiper rolls 3 and 4 agrees with the center line of the rolling line. Other constitutions are the same as in the Third Embodiment.

In the present embodiment as well, the gap between the wiper rolls 3 and 4 is supported at four points by the bearings 13. Other actions and effects are the same as in the Third Embodiment.

Sixth Embodiment

Figure 8:
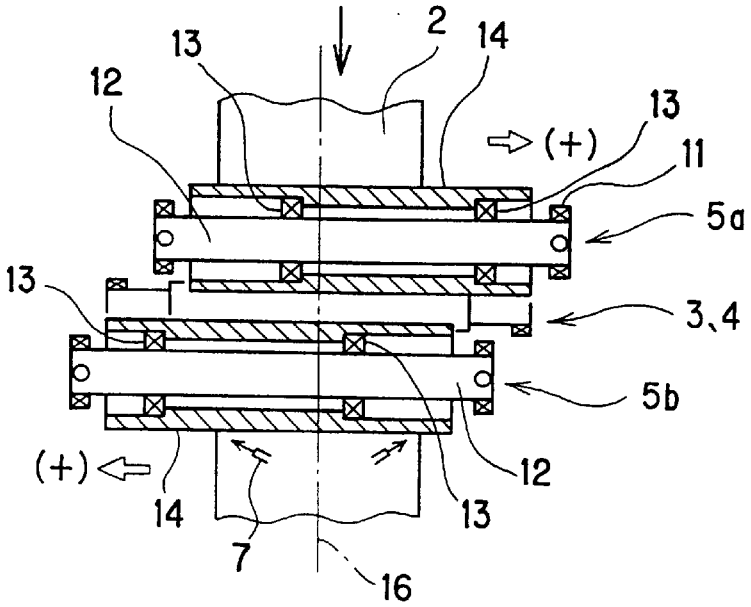
FIG. 8 is a sectional view of a wiper apparatus according to a sixth embodiment of the present invention.

FIG. 8 is a sectional view of a wiper apparatus according to a sixth embodiment of the present invention.

This embodiment is a wiper apparatus having upper and lower wiper rolls 3 and 4 supported by two backup rolls 5*a*, 5*b* and 6*a*, 6*b*, respectively, as in the case of the Third Embodiment, in which, however, right and left sleeve support bearings 13 and 13 are arranged in point symmetry for the upper two single-sleeve type backup rolls 5*a* and 5*b*, and the lower two single-sleeve type backup rolls 6*a* and 6*b*, and only the upper two single-sleeve type backup rolls 5*a* and 5*b* can be adjusted to be moved axially in opposite directions relative to each other.

That is, the bearings 13, 13 for supporting the single-sleeves 14 of the right and left backup rolls 5*a* and 5*b*, and the right and left backup rolls 6*a* and 6*b* are arranged in point symmetry in a zero shift amount state in which the center of the right and left backup rolls 5*a* and 5*b*, the right and left backup rolls 6*a* and 6*b*, and the wiper rolls 3 and 4 agrees with the center line of the rolling line. As shown in the drawing, only the upper two single-sleeve type backup rolls 5*a* and 5*b* can be adjusted to be moved in roll axial directions. Other constitutions are the same as in the Third Embodiment.

With such constitutions, the upper backup rolls 5*a*, 5*b* and the lower backup rolls 6*a*, 6*b* are moved in the directions of arrows (+ direction) or in directions opposite to the arrows. As a result, the support span for the sleeves of the upper backup rolls 5*a*, 5*b* and the lower backup rolls 6*a*, 6*b* by the bearings 13 is changed, and the gap between the wiper rolls 3 and 4 is supported at four points by the bearings 13.

Thus, the lower backup rolls 6*a*, 6*b* need not be controlled to be moved in the shifting direction, so that the roll shifting mechanism can be simplified. Besides, the upper backup rolls have been shifted in the present embodiment, but instead the lower backup rolls may be shifted. Other actions and effects are the same as in the Third Embodiment.

Seventh Embodiment

Figure 10A:
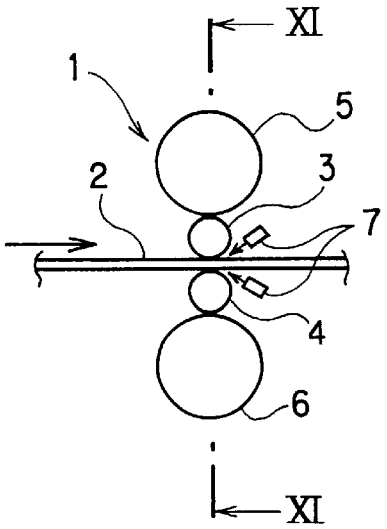
FIGS. 10(*a*) and 10(*b*) are each a side view of a roll configuration of a wiper apparatus according to a seventh embodiment of the present invention, with FIG. 10(*a*) showing a state in which the wiper roll has an offset amount of zero, and FIG. 10(*b*) showing a state in which the wiper roll has an offset amount of $\alpha$.
Figure 10B:
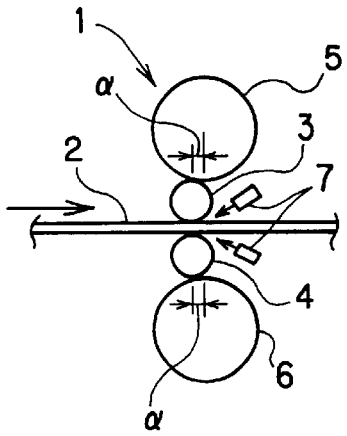
Figure 11:
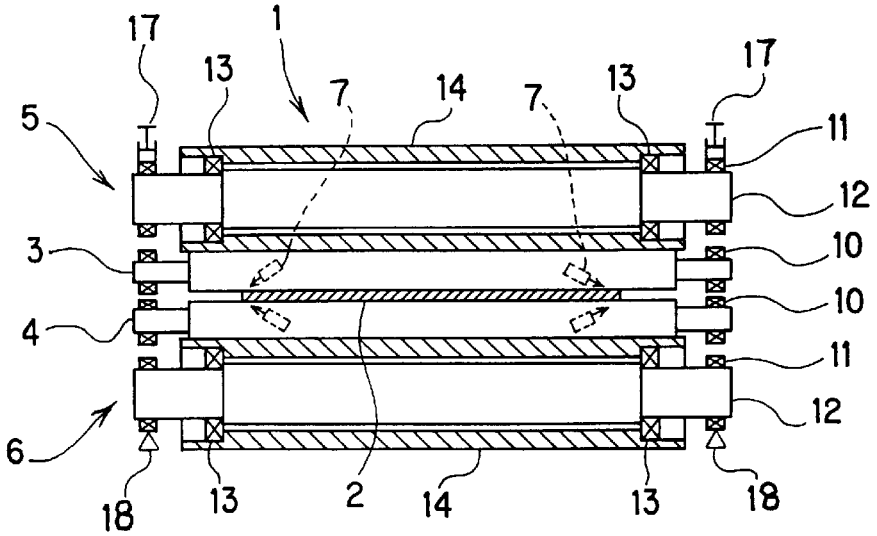
FIG. 11 is a view taken along XI—XI of FIG. 10(*a*).
Figure 12:
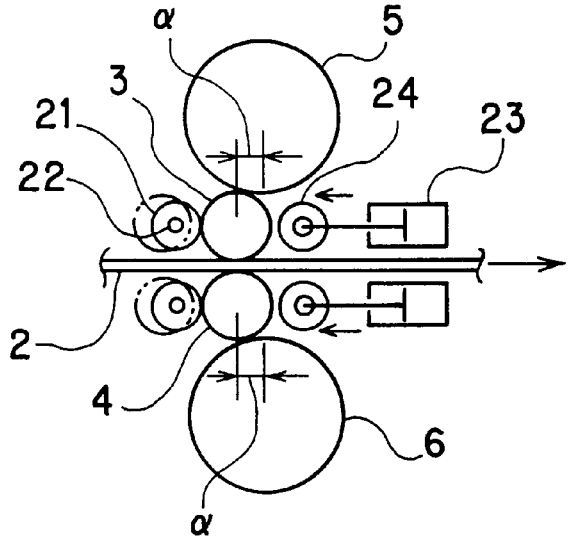
FIG. 12 is a side view showing offset amount adjusting means of the wiper apparatus.
Figure 18A:
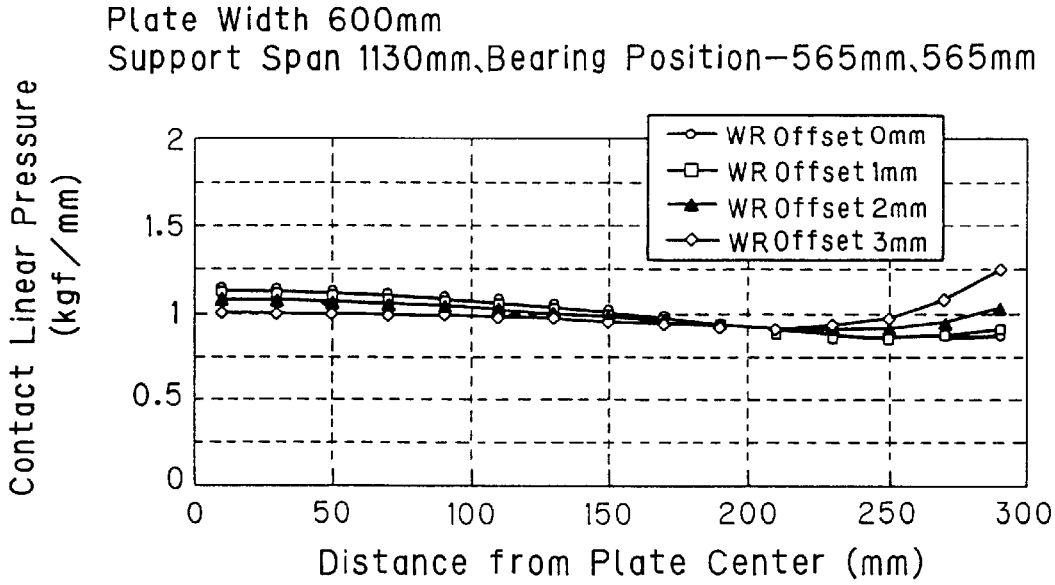
FIGS. 18(*a*) and 18(*b*) are each a diagram showing the relation between the offset amount and the contact surface pressure according to the present invention, in which FIG. 18(*a*) shows the strip plate with a plate width of 600 mm, and FIG. 18(*b*) shows the strip plate with a plate width of 1,100 mm.
Figure 18B:
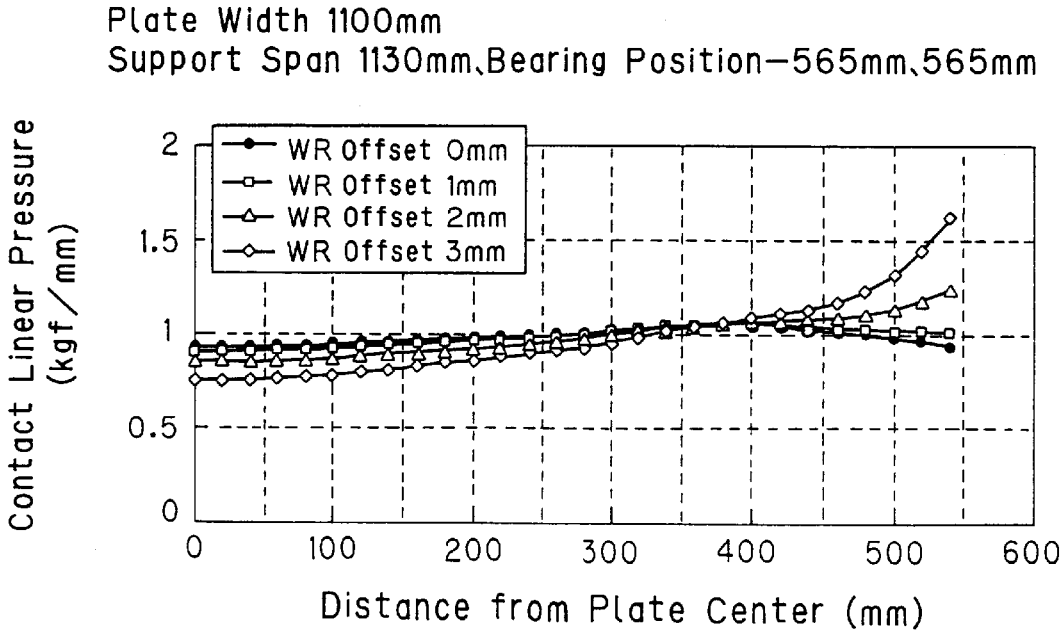
Figure 21A:
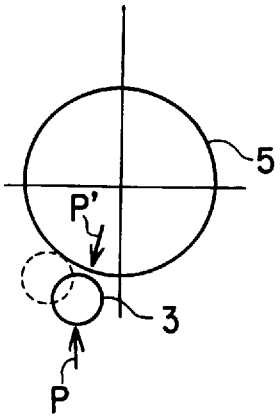
FIGS. 21(*a*) and 21(*b*) are explanation views for principle when the wiper roll has been offset, in which FIG. 20(*a*) is a side view of an essential part, while FIG. 20(*b*) is a front view of the essential part.
Figure 21B:
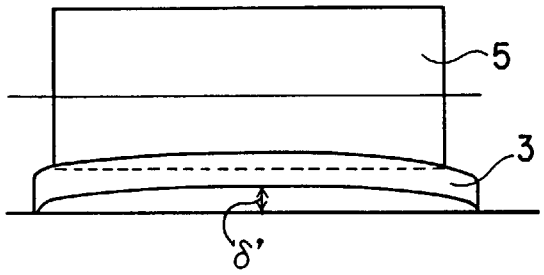

FIGS. 10(*a*) and 10(*b*) are each a side view of a roll configuration of a wiper apparatus according to a seventh embodiment of the present invention, with FIG. 10(*a*) showing a state in which the wiper roll has an offset amount of zero, and FIG. 10(*b*) showing a state in which the wiper roll has an offset amount of α. FIG. 11 is a view taken along XI—XI of FIG. 10(*a*). FIG. 12 is a side view showing offset amount adjusting means of the wiper apparatus. FIGS. 18(*a*) and 18(*b*) are each a diagram showing the relation between the offset amount and the contact surface pressure according to the present invention, in which FIG. 18(*a*) shows the strip plate with a plate width of 600 mm, and FIG. 18(*b*) shows the strip plate with a plate width of 1,100 mm. FIGS. 21(*a*) and 21(*b*) are explanation views for principle when the wiper roll has been offset.

In this embodiment, upper and lower wiper rolls 3 and 4 having a strip plate 2 sandwiched therebetween are constituted such that the amounts of their movement toward an entry side from a vertical line passing through upper and lower backup rolls 5 and 6 (the amount of movement is called an offset amount) can be adjusted to be variable. Furthermore, crowning has been applied to the upper and lower wiper rolls 3 and 4 such that the diameters of the middle portions in the barrel length (roll axis direction) of the upper and lower wiper rolls 3 and 4 are large and gradually decrease toward the ends thereof.

In FIG. 10, the reference numeral 1 denotes a wiper apparatus, and 2 a strip plate as a rolled material to be wiped with the wiper apparatus 1.

The wiper apparatus 1 is composed of a small-diameter upper wiper roll 3 and a small-diameter lower wiper roll 4 having both ends supported by bearings on upper and lower frames (not shown) in such a manner as to sandwich the strip plate 2; a single-sleeve type upper backup roll 5 and a single-sleeve type lower backup roll 6 having both ends supported by bearings on the upper and lower frames (not shown) in such a manner as to contact the wiper rolls 3 and 4; and upper and lower air jet nozzles 7 provided on the exit side of the upper and lower wiper rolls 3 and 4.

The small-diameter upper and lower wiper rolls 3 and 4 are rolls for wiping off a liquid material, such as a rolling oil, on the surfaces of the strip plate 2. The upper and lower backup rolls 5 and 6 are larger in diameter than the upper and lower wiper rolls 3 and 4, and have a sleeve structure (see FIG. 11), in order to suppress warpage due to pressing loads.

As shown in FIG. 10(*b*), moreover, the upper and lower wiper rolls 3 and 4 are provided with offset amount adjusting means (see FIG. 12) capable of setting the upper and lower wiper rolls 3 and 4 in an arbitrary offset amount α.

In FIG. 11, the upper wiper roll 3 and the lower wiper roll 4 have crownings which make the diameters of the middle portions in the barrel length of the upper and lower wiper rolls 3 and 4 large and gradually decrease toward the ends thereof. The ends of the upper and lower wiper rolls 3 and 4 are rotatably supported via bearings 10 in offset type bearing housings which are slidable toward an entry side on the upper and lower frames.

The upper backup roll 5 and the lower backup roll 6 are each composed of a support shaft 12 having both ends rotatably supported by bearings 11 on the upper or lower frame (not shown), and a single sleeve 14 rotatably supported by bearings 13 at two sites on the support shaft 12.

The two bearings 13 on the support shaft 12 supporting the single sleeve 14 are provided in such a manner as to be located outward of the plate width of the strip plate 2.

Pressing cylinders 17 are connected to the upper frame, and pressing forces imposed by the pressing cylinders 17 on the support shafts 12 of the backup rolls 5 and 6 are supported by the bearing housings of the lower frame at support points 18.

FIG. 12 shows offset amount adjusting means. At the roll neck on the offset side of the upper wiper roll 3 (lower wiper roll 4) (i.e., the entry side of the strip plate 2), a rotatable positioning ring 21 mounted on an eccentric shaft 22 is provided as means for setting the offset position. On the counter-offset side (exit side of the strip plate 2), a rotatable pressing ring 24 connected to a hydraulic cylinder 23 is provided for pressing the upper wiper roll 3 (lower wiper roll 4) against the offset position.

These offset amount adjusting means have been shown in FIG. 12 to be disposed above and below the strip plate 2, but this manner of disposition is not limitative, and these means may be disposed either above or below the strip plate 2. The offset amount α of the upper wiper roll 3 (lower wiper roll 4) may be provided on the exit side, rather than on the entry side, of the strip plate 2. In this case, conversely to the example of FIG. 12, the positioning ring 21 is provided on the offset side (exit side), while the pressing ring 24 is provided on the counter-offset side (entry side).

The offset amount adjusting means can move the bearings 10 of the upper and lower wiper rolls 3 and 4 to position the upper and lower wiper rolls 3 and 4 in the predetermined offset amount α.

Further, installation of the pressing means composed of the hydraulic cylinder 23 and the pressing ring 24 on the counter-offset side can be omitted.

According to the wiper apparatus for a liquid material, which has been constituted as above, the pressing force imposed on the support shaft 12 of the upper or lower backup roll 5 or 6 by the pressing cylinder 17 is transmitted from the bearings 13 at the two sites on the support shaft 12 to the single sleeve 14, pressing the wiper roll 3 or 4 against the strip plate 2 via the single sleeve 14.

Wiping of the rolled strip plate 2 is performed in the following manner: The wiper rolls 3 and 4 having crownings are adjusted to be moved in the predetermined offset amount α (e.g., about 1 to 5 mm) Then, while the strip plate 2 is being passed, the wiper rolls 3 and 4 are pressed down by the pressing force of the pressing cylinders 17. As a result, the wiper rolls 3 and 4 are pressed against the strip plate 2 and rotated in such a manner as to follow the strip plate 2, whereby the liquid material on the strip plate surfaces, such as a rolling oil, is wiped. Then, the liquid material on the side portions of the strip plate 2 is blown off by the air jet nozzles 7 on the exit side of the wiper rolls 3 and 4.

Setting of the wiper rolls 3 and 4 in the predetermined offset amount α is performed in the following manner: As shown in FIG. 12, the eccentric shaft 22 is rotated first to move the positioning ring 21 so that the wiper rolls 3 and 4 will have the offset amount α. Then, the position of the eccentric shaft 22 is fixed. Then, the hydraulic cylinder 23 on the counter-offset side (exit side of the strip plate 2) is actuated to press the pressing ring 24 against the wiper roll 3 or 4 and support the wiper roll 3 or 4.

Wiping is carried out as described above, with the wiper rolls 3 and 4 being pressed and supported and the predetermined offset amount α being maintained. Wiping loads on the wiper rolls 3 and 4 cause warped deformation in their barrel length middle portions. However, crownings are formed in the wiper rolls 3 and 4, so that the strip plate and the wiper rolls are brought into uniform contact, and the contact linear pressure distribution can be uniformed.

In varying the wiping load according to a change in the plate width, the offset amount α is adjusted, whereby the contact linear pressure distribution can be uniformed.

FIG. 18(*a*) shows the relation between the offset amount and the contact linear pressure when the average unit width load is 1 kgf/mm and the plate width is 600 mm. When the offset amount is 2 mm, variation in the contact linear pressure is minimal, and the contact linear pressure is averaged. FIG. 18(*b*) shows the same relation when the plate width is 1,100 mm. In this case, when the offset amount is 0 or 1 mm, variation in the contact linear pressure is minimal.

That is, according to the present embodiment, as shown in FIGS. 21(*a*) and 21(*b*), excessive crowning δ" is applied to the wiper roll 3, as in the aforementioned FIG. 19(*c*), and the wiper roll 3 is moved in the line direction of the strip plate from the position immediate below the backup roll 5 (i.e., the wiper roll 3 is offset). As a result, the wiper roll 3 warps in the line direction as well, and is pressed against the backup roll 5, whereby the warpage in the up-and-down direction is increased from δ to δ' to cancel out the influence of the excessive crowning. The larger the offset amount, the greater the horizontal component (inclination) of the reaction force P' from the backup roll 5 and the height of the surface of the backup roll 5 from the rolling line. Hence, when the offset amount is increased, warpage of the wiper roll 3 also increases. By adjusting the offset amount in response to the pressing force, therefore, wiping under various conditions can be performed using one type of crowning roll.

According to the present embodiment as described above, crowning has been formed in the wiper roll, and the offset amount can be adjusted. Thus, even when the plate width of the strip plate changes, the contact linear pressure distribution can be uniformed, and the liquid material adhering to the rolled material can be wiped off satisfactorily.

Since the contact linear pressure distribution can be uniformed, moreover, local plastic deformation can be prevented, and the product quality of the strip plate can be improved.

Furthermore, even for the strip plate formed of a material which is too easily plastically deformable to receive a high load, the contact linear pressure distribution can be uniformed, so that the quality deterioration of the strip plate can be prevented.

Eighth Embodiment

Figure 13:
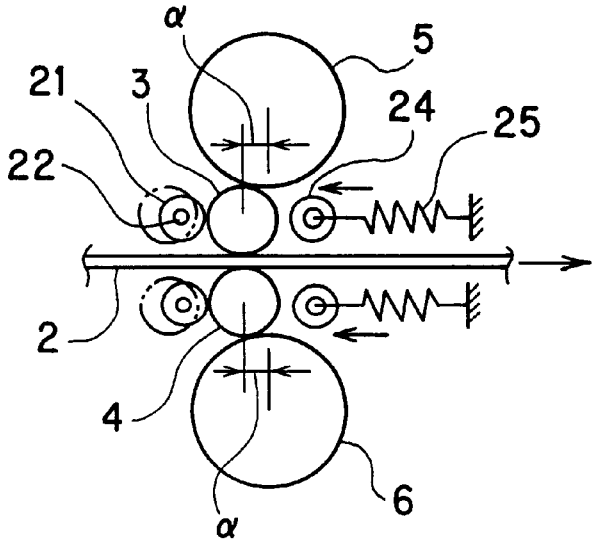
FIG. 13 is a side view showing offset amount adjusting means according to an eighth embodiment of the present invention.

FIG. 13 is a side view showing offset amount adjusting means according to an eighth embodiment of the present invention. In this drawing, the same members as in FIGS. 10 to 13 are assigned the same reference numerals, and overlapping explanations are omitted.

In the present embodiment, the hydraulic cylinder engaged with the pressing ring on the counter-offset side of the wiper roll in the Seventh Embodiment has been replaced by an expansion spring. Other constitutions are the same as in the Seventh Embodiment.

In FIG. 13, a pressing ring 24 coupled to an expansion spring 25 comprising a helical spring is disposed on the counter-offset side of the wiper roll 3 or 4 (the exit side of a strip plate 2).

Constitutions other than the above are the same as in the Seventh Embodiment, and their explanations are omitted.

According to a wiper apparatus for a liquid material which has been constituted as in the present embodiment, setting of the wiper rolls 3 and 4 in a predetermined offset amount α is performed in the following manner: As shown in FIG. 13, an eccentric shaft 22 on the offset side is moved first to move a positioning ring 21 so that the wiper rolls 3 and 4 will have the offset amount α. Then, the position of the eccentric shaft 22 is fixed. Then, the expansion spring 25 on the counter-offset side is expanded to press the pressing ring 24 against the wiper roll 3 or 4 and support the wiper roll 3 or 4.

With the wiper rolls 3 and 4 being pressed and supported and the predetermined offset amount α being maintained, wiping is carried out, whereby a liquid material, such as a rolling oil, on the surfaces of the strip plate 2 can be wiped off.

According to the present embodiment, as described above, pressing/supporting means can be simplified in comparison with the hydraulic cylinder mode of the Seventh Embodiment, so that the equipment cost and the operating cost can be reduced.

In addition, the same actions and effects as in the Seventh Embodiment are obtained.

Ninth Embodiment

Figure 14:
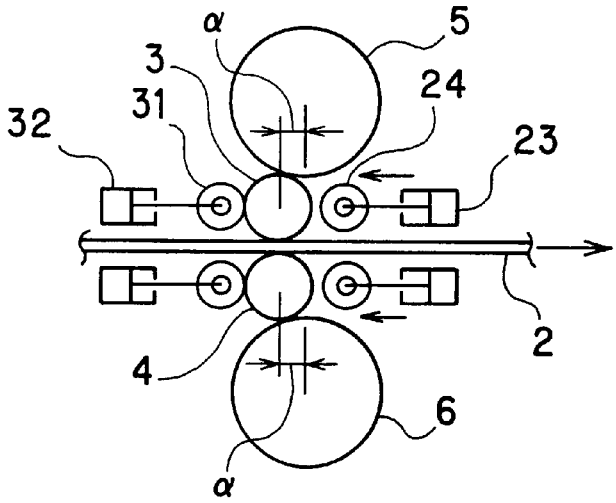
FIG. 14 is a side view showing offset amount adjusting means according to a ninth embodiment of the present invention.

FIG. 14 is a side view showing offset amount adjusting means according to a ninth embodiment of the present invention. In this drawing, the same members as in FIGS. 10 to 13 are assigned the same reference numerals, and overlapping explanations are omitted.

In the present embodiment, the positioning means engaged with the positioning ring on the offset side of the wiper roll in the Seventh Embodiment has been replaced by a hydraulic cylinder. Other constitutions are the same as in the Seventh Embodiment.

In FIG. 14, a hydraulic cylinder 32 coupled to a rotatable positioning ring 31 is disposed on the offset side of a wiper roll 3 or 4 (the entry side of a strip plate 2).

Constitutions other than the above are the same as in the Seventh Embodiment, and their explanations are omitted.

According to a wiper apparatus for a liquid material which has been constituted as in the present embodiment, setting of the wiper rolls 3 and 4 in a predetermined offset amount $\alpha$ is performed in the following manner: As shown in FIG. 14, the hydraulic cylinder 32 on the offset side is actuated first to move the positioning ring 31 so that the wiper rolls 3 and 4 will have the offset amount $\alpha$. Then, the position of the hydraulic cylinder 32 is fixed. Then, a hydraulic cylinder 23 on the counter-offset side is actuated to press a pressing ring 24 against the wiper roll 3 or 4 and support the wiper roll 3 or 4.

With the wiper rolls 3 and 4 being pressed and supported and the predetermined offset amount $\alpha$ being maintained, wiping is carried out, whereby a liquid material, such as a rolling oil, on the surfaces of the strip plate 2 can be wiped off.

According to the present embodiment, as described above, positioning is performed by movement in the horizontal direction, so that position setting is easy, in comparison with the eccentric shaft of the Seventh Embodiment.

In addition, the same actions and effects as in the Seventh Embodiment are obtained.

Tenth Embodiment

Figure 15:
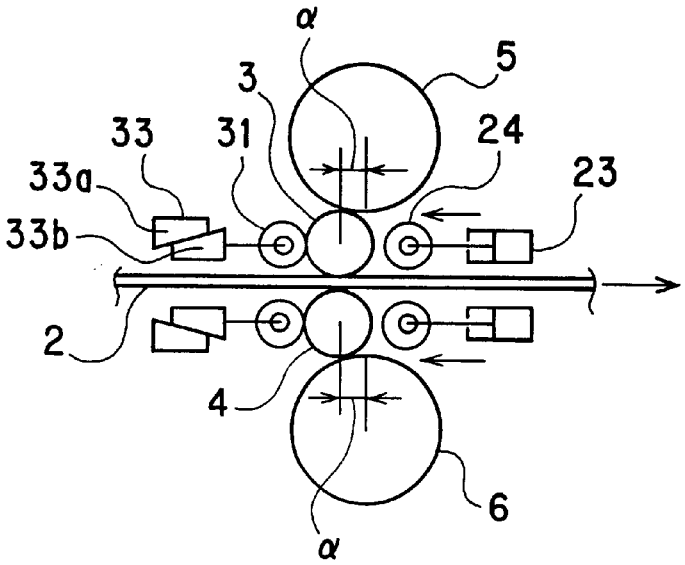
FIG. 15 is a side view showing offset amount adjusting means according to a tenth embodiment of the present invention.

FIG. 15 is a side view showing offset amount adjusting means according to a tenth embodiment of the present invention. In this drawing, the same members as in FIGS. 10 to 13 are assigned the same reference numerals, and overlapping explanations are omitted.

In the present embodiment, the positioning means engaged with the positioning ring on the offset side of the wiper roll in the Seventh Embodiment has been replaced by a slide mechanism. Other constitutions are the same as in the Seventh Embodiment.

In FIG. 15, a slide mechanism 33 coupled to a rotatable positioning ring 31 is disposed on the offset side of a wiper roll 3 or 4 (the entry side of a strip plate 2). The slide mechanism 33 is composed of a combination of two rectangular bodies 33*a* and 33*b* each having an inclined surface. The rectangular body 33*b* is slid relative to the rectangular body 33*a*, whereby the positioning ring 31 can be moved in the horizontal direction.

Constitutions other than the above are the same as in the Seventh Embodiment, and their explanations are omitted.

According to a wiper apparatus for a liquid material which has been constituted as in the present embodiment, setting of the wiper rolls 3 and 4 in a predetermined offset amount $\alpha$ is performed in the following manner: As shown in FIG. 15, the slide mechanism 33 on the offset side is actuated first to move the positioning ring 31 so that the wiper rolls 3 and 4 will have the offset amount $\alpha$. Then, the position of the slide mechanism 33 is fixed. Then, a hydraulic cylinder 23 on the counter-offset side is actuated to press a pressing ring 24 against the wiper roll 3 or 4 and support the wiper roll 3 or 4.

With the wiper rolls 3 and 4 being pressed and supported and maintained in the predetermined offset amount $\alpha$, wiping is carried out, whereby a liquid material, such as a rolling oil, on the surfaces of the strip plate 2 can be wiped off.

According to the present embodiment, as described above, positioning is performed by movement in the horizontal direction, so that position setting is easy, in comparison with the eccentric shaft of the Seventh Embodiment.

In addition, the same actions and effects as in the Seventh Embodiment are obtained.

Eleventh Embodiment

Figure 16:
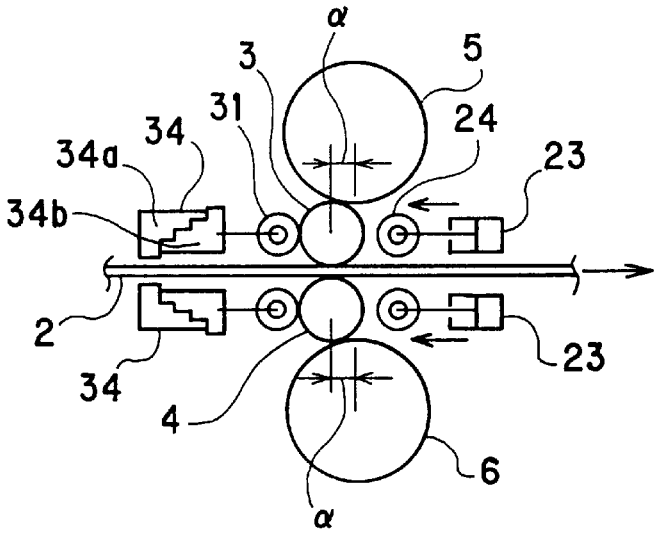
FIG. 16 is a side view showing offset amount adjusting means according to an eleventh embodiment of the present invention.

FIG. 16 is a side view showing offset amount adjusting means according to an eleventh embodiment of the present invention. In this drawing, the same members as in FIGS. 10 to 13 are assigned the same reference numerals, and overlapping explanations are omitted.

In the present embodiment, the positioning means engaged with the positioning ring on the offset side of the wiper roll in the Seventh Embodiment has been replaced by a stairs-like slide mechanism. Other constitutions are the same as in the Seventh Embodiment.

In FIG. 16, a stairs-like slide mechanism 34 coupled to a rotatable positioning ring 31 is disposed on the offset side of a wiper roll 3 or 4 (the entry side of a strip plate 2). The stairs-like slide mechanism 34 is composed of a combination of two rectangular bodies 34*a* and 34*b* each having a stairs-like surface. The rectangular body 34*b* is slid relative to the rectangular body 34*a*, with the stairs-like surfaces being slid relative to each other, whereby the positioning ring 31 can be moved horizontally with a stepped pitch.

Constitutions other than the above are the same as in the Seventh Embodiment, and their explanations are omitted.

According to a wiper apparatus for a liquid material which has been constituted as in the present embodiment, setting of the wiper rolls 3 and 4 in a predetermined offset amount $\alpha$ is performed in the following manner: As shown in FIG. 16, the slide mechanism 34 on the offset side is actuated first to move the positioning ring 31 so that the wiper rolls 3 and 4 will have the offset amount a. Then, the position of the stairs-like slide mechanism 34 is fixed. Then, a hydraulic cylinder 23 on the counter-offset side is actuated to press a pressing ring 24 against the wiper roll 3 or 4 and support the wiper roll 3 or 4.

With the wiper rolls 3 and 4 being pressed and supported and maintained in the predetermined offset amount $\alpha$, wiping is carried out, whereby a liquid material, such as a rolling oil, on the surfaces of the strip plate 2 can be wiped off.

According to the present embodiment, as described above, positioning is performed by horizontal movement with a stepped pitch, so that position setting is easy, in comparison with the eccentric shaft of the Seventh Embodiment.

In addition, the same actions and effects as in the Seventh Embodiment are obtained.

Twelfth Embodiment

Figure 17:
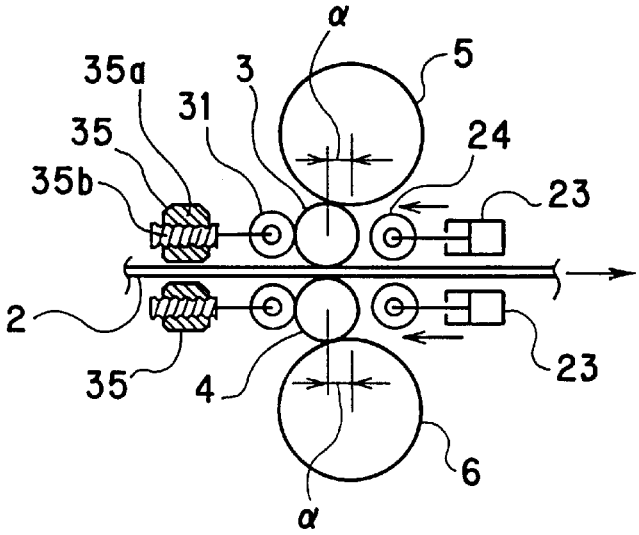
FIG. 17 is a side view showing offset amount adjusting means according to a twelfth embodiment of the present invention.

FIG. 17 is a side view showing offset amount adjusting means according to a twelfth embodiment of the present invention. In this drawing, the same members as in FIGS. 10 to 13 are assigned the same reference numerals, and overlapping explanations are omitted.

In the present embodiment, the positioning means engaged with the positioning ring on the offset side of the wiper roll in the Seventh Embodiment has been replaced by a screw mechanism. Other constitutions are the same as in the Seventh Embodiment.

In FIG. 17, a screw mechanism 35 coupled to a rotatable positioning ring 31 is disposed on the offset side of a wiper roll 3 or 4 (the entry side of a strip plate 2). The screw mechanism 35 is composed of a combination of an internally threaded screw 35*a* on a fixed side and an externally threaded screw 35*b* on a moving side. The externally threaded screw 35*b* is rotated, whereby the positioning ring 31 can be moved horizontally.

Constitutions other than the above are the same as in the Seventh Embodiment, and their explanations are omitted.

According to a wiper apparatus for a liquid material which has been constituted as in the present embodiment, setting of the wiper rolls 3 and 4 in a predetermined offset amount $\alpha$ is performed in the following manner: As shown in FIG. 17, the screw mechanism 35 on the offset side is actuated first to move the positioning ring 31 so that the wiper rolls 3 and 4 will have the offset amount $\alpha$. Then, the position of the screw mechanism 35 is fixed. Then, a hydraulic cylinder 23 on the counter-offset side is actuated to press a pressing ring 24 against the wiper roll 3 or 4 and support the wiper roll 3 or 4.

With the wiper rolls 3 and 4 being pressed and supported and maintained in the predetermined offset amount $\alpha$, wiping is carried out, whereby a liquid material, such as a rolling oil, on the surfaces of the strip plate 2 can be wiped off.

According to the present embodiment, as described above, positioning is performed by horizontal movement in accordance with rotation of the screws. Thus, position setting is easy, and the equipment cost and the operating cost can be reduced, in comparison with the Seventh Embodiment.

In addition, the same actions and effects as in the Seventh Embodiment are obtained.

Needless to say, the present invention is not restricted to the above-described embodiments, and various changes and modifications may be made, if they do not deviate from the gist of the invention.

Industrial Applicability

As discussed above, the wiper apparatus for a liquid material according to the present invention uniforms the contact linear pressure distribution of the wiper rolls on the rolled material, by arranging the positions of the bearings for supporting the sleeves of the backup rolls, which reinforce the wiper rolls, in point symmetry in the up-and-down direction; or by offsetting the wiper rolls, in which crowning has been formed, in the line direction of the rolled material from the position immediately below the backup roll. This wiper apparatus is preferred when used as a wiper apparatus for wiping off a rolling oil which has adhered to a strip plate rolled by a cold rolling mill or the like.

What is claimed is:

1. Wiper apparatus for a liquid material, which sandwiches a moving rolled material between upper and lower wiper rolls to squeeze out the liquid material adhering to the rolled material, comprising:

upper and lower backup rolls for reinforcing the upper and lower wiper rolls, each of said backup rolls having a single sleeve rotatably supported by two bearings on a roll shaft, and wherein the two bearings on the upper and lower backup rolls are disposed on the roll shafts in mutually offset relationship relative to a center line of the rolled material and have a substantially shorter span than a barrel length of the sleeve and wherein the two bearings on the upper backup roll are offset from the two bearings on the lower backup roll and are in point symmetry about the center line of the rolled material.

2. Wiper apparatus for a liquid material as claimed in claim 1, wherein the upper and lower backup rolls are movable axially in mutually opposite directions.

3. Wiper apparatus for a liquid material as claimed in claim 1, wherein an inner surface of the single sleeve is formed of a stepped surface so that a middle portion thereof will be thick-walled and both ends thereof will be thin-walled, and wherein the bearings are disposed fixedly at stepped portions of the stepped surface.

4. Wiper apparatus for a liquid material as claimed in claim 3, wherein the upper and lower backup rolls each includes two backup rolls for respectively reinforcing the upper and lower wiper rolls.

5. Wiper apparatus for a liquid material as claimed in claim 4 wherein the span of the middle portions of both the upper and lower backup rolls, taken together, is about equal to or greater than a width dimension of the rolled material.

6. Wiper apparatus span for a liquid material as claimed in claim 3 wherein the span of the middle portions of the upper and lower backup rolls, taken together, is about equal to or greater than a width dimension of the rolled material.

7. Wiper apparatus for a liquid material as claimed in claim 1, wherein the upper and lower backup rolls each include one backup roll for respectively reinforcing the upper and lower wiper rolls.

8. Wiper apparatus for a liquid material, which sandwiches a moving rolled material between upper and lower wiper rolls to squeeze out the liquid material adhering to the rolled material, comprising:

upper and lower pairs of backup rolls, comprising a right backup roll and a left backup roll, respectively supporting each of the upper and lower wiper rolls, each of the backup rolls including a single sleeve and a set of support bearings, and wherein the support bearings supporting the sleeves of the upper pair of backup rolls are disposed in mutually offset relationship in point symmetry about a center line of the rolled material adjacent the upper wiper roll, and the support bearings supporting the sleeves of the lower pain of backup rolls are disposed in mutually offset relationship in point symmetry about said center line adjacent the lower wiper roll and wherein the set of bearings on the upper pair of backup rolls are offset from the set of bearings on the lower pair of backup rolls.

9. Wiper apparatus for a liquid material as claimed in claim 8, wherein either the two backup rolls adjacent the upper wiper roll or the two backup rolls adjacent the lower wiper roll are selectively adjustable so as to be moved axially relative to one another in mutually opposite directions.

* * * * *